US005176496A

United States Patent [19]

Correia et al.

[11] Patent Number: 5,176,496

[45] Date of Patent: Jan. 5, 1993

[54] MOUNTING ARRANGEMENTS FOR TURBINE NOZZLES

[75] Inventors: Victor H. S. Correia, Cincinnati; Richard W. Albrecht, Fairfield, both of Ohio

[73] Assignee: General Electric Company, Cincinnati, Ohio

[21] Appl. No.: 766,297

[22] Filed: Sep. 27, 1991

[51] Int. Cl.[5] ..... F04D 29/54

[52] U.S. Cl. ..... 415/209.2; 415/189; 415/190

[58] Field of Search ..... 415/208.1, 209.2, 209.3, 415/189, 190

[56] References Cited

U.S. PATENT DOCUMENTS

| | | | |
|---|---|---|---|
| 2,858,104 | 10/1958 | Felk et al. | 415/190 |
| 3,104,091 | 9/1963 | Vivian | 415/190 |
| 4,194,869 | 3/1980 | Corcokios | 415/189 |
| 4,391,565 | 7/1983 | Speak | 415/189 |
| 4,621,976 | 11/1986 | Marshall et al. | 415/209.2 |
| 4,815,933 | 3/1989 | Hansel et al. | 415/189 |
| 4,856,963 | 8/1989 | Klapproth et al. | 415/190 |

*Primary Examiner*—John T. Kwon

*Attorney, Agent, or Firm*—Jerome C. Squillaro

[57] ABSTRACT

An inventive turbine nozzle attachment comprises a nozzle mount having a radial and tangential load carrying hook and a radial load carrying land. The nozzle hook fits onto a stud in a stationary nozzle support. The stud is adapted for carrying the tangential and radial load from a respective one of a plurality of nozzle segments, each nozzle segment includes a nozzle mount for coupling to a corresponding stud. The plurality of nozzle segments are joined circumferentially to form an annular turbine nozzle. Each nozzle segment further includes the radial land on one circumferential end of the mount and a circumferentially extending support member on an opposite circumferential end of the segment. The radial support member of one segment rests on the land of an adjacent segment. The gas loads on the nozzle segments cause each segment to load up on the support studs in the tangential and radial directions. The support members on each opposite segment end load radially downward on a land of an adjacent segment. The axial load is taken by the axially aft surfaces of the support member and hook against the stationary, radially outer nozzle support.

5 Claims, 1 Drawing Sheet

MOUNTING ARRANGEMENTS FOR TURBINE NOZZLES

BACKGROUND OF THE INVENTION

The present invention relates to gas turbine engines and, more particularly, to mounting arrangements for turbine nozzles.

Turbine nozzles within a gas turbine engine provide the function of directing and/or re-directing hot gas flow from a turbine engine combustor into a more efficient direction for impinging on and effecting rotation of turbine rotor stages. A nozzle comprises a plurality of radially extending airfoils arranged circumferentially about an engine axis, the airfoils being supported by radially inner and outer circumferential bands. Either the inner or outer band may include some form of flange for coupling the nozzle to a stationary engine mounting structure. In general, a plurality of turbine nozzles is interleaved with a plurality of turbine rotor stages. At least some of the nozzles are supported only at their radially outer band in essentially a cantilever type arrangement since their radially inner band extends adjacent a rotating engine structure to which the turbine rotor stages are attached. The directing process performed by the nozzles also accelerates gas flow resulting in a static pressure reduction between inlet and outlet planes and high pressure loading of the nozzles. Additionally, the nozzles experience high thermal gradients from the hot combustion gases and the coolant air at the radial mounting surfaces.

In common mounting systems, the turbine nozzle may be attached by bolts or a combination of bolts and some form of clamping arrangement to an engine support structure. In some stages, such as the first stage nozzle, the nozzle is attached to the engine stationary structure via a radially inner mount or flange structure coupled to the inner band. The radially outer band is not mechanically retained but is supported against axial forces by a circumferential engine flange. In other stages, such as stage 2 of an engine, the nozzle may be attached at its radially outer band but be free at its radially inner band.

In either design, the use of bolts and clamps at circumferential locations about a nozzle band act as a restriction to the band, which band is hotter than the structure to which it is attached, causing radial bowing of the outer band of the nozzle and stressing of the airfoils attached to the band. Such stressing of the airfoils may lead to formation of cracks in the airfoil trailing edge.

SUMMARY OF THE INVENTION

The present invention overcomes the above mentioned disadvantages as well as others of bolted or clamped turbine nozzles by eliminating such bolting and clamping while providing a positive attachment between a turbine nozzle and an adjacent engine support structure. In one form, the inventive turbine nozzle attachment comprises a nozzle mount having a radial and tangential load carrying hook and a radial load carrying land. The nozzle hook fits onto a stud in a stationary nozzle support, the stud being adapted for carrying the tangential and radial load from a respective one of a plurality of nozzle segments. The plurality of nozzle segments are joined circumferentially to form an annular turbine nozzle. Each nozzle segment includes a nozzle mount for coupling to a corresponding stud.

Each nozzle segment further includes the radial land on one circumferential end of the mount and a circumferentially extending support member on an opposite circumferential end of the segment. The radial support member of one segment rests on the land of an adjacent segment. The gas loads on the nozzle segments cause each segment to load up on the support studs in the tangential and radial directions. The support members on each opposite segment end load radially downward on a land of an adjacent segment. The axial load is taken by the axially aft surfaces of the support member and hook against the stationary, radially outer nozzle support. One advantage of this turbine nozzle mounting arrangement is the elimination of tangential stiffness, as compared to the prior bolted design, thus minimizing the stresses induced in the airfoil trailing edge due to thermal distortion of the nozzle mount. Another advantage is a lighter weight design having fewer parts and easier assembly and disassembly.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
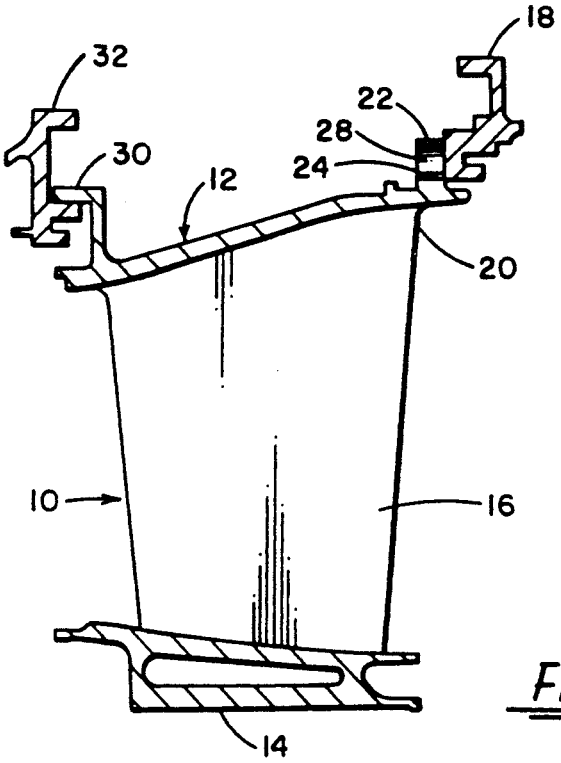
FIG. 1 is a tangential view of a turbine nozzle segment coupled within a turbine in accordance with the present invention.
Figure 2:
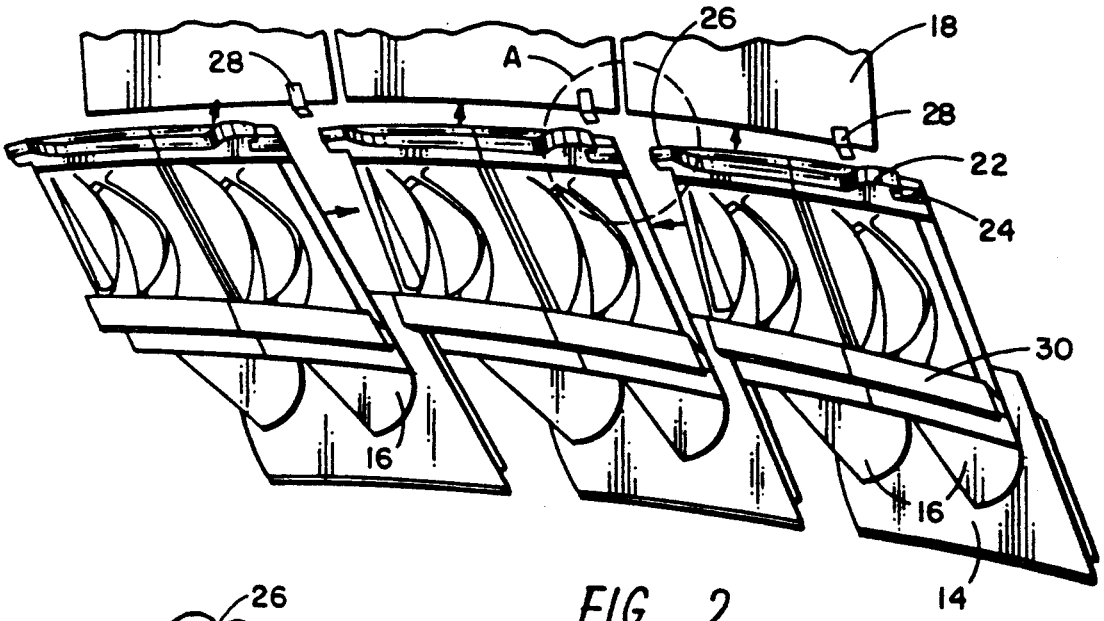
FIG. 2 is a partial exploded view, taken generally axially, of the turbine mounting arrangement of FIG. 1.

Referring to the figures, generally and in particular to FIGS. 1 and 2, there is shown a tangential view of a turbine nozzle segment 10 within a gas turbine engine and a generally radial view of a turbine nozzle, respectively. The nozzle segments 10 are arranged in a circumferentially abutting relationship about the turbine engine to form a generally continuous nozzle. Each segment 10 includes a radially outer mount or band 12 and a radially inner band 14. In the illustrative embodiment, each segment 10 includes a pair of airfoils 16 extending between the inner and outer bands. In an assembled configuration, the inner bands 14 abut the adjacent band 14 of adjacent segments to form a generally continuous radially inner band which acts as an inner boundary of a gas flowpath for gases flowing through the turbine engine. The bands 14 may include slots in their circumferential ends for receiving metal leaf seals (not shown) to reduce gas leakage between adjacent segments.

The illustrative nozzle segments 10 are of a type which are mounted at their radially outer bands 12 to a stationary support, such as support 18, which is attached to the structural frame (not shown) of the turbine engine. In prior art systems, the outer band 12 is typically bolted to the support 18. The temperature of support 18 is sufficiently less than that of band 12 to result in differential thermal expansion which tends to warp band 12 and stress the attached airfoils 16 to a point such that cracking of the airfoil trailing edges 20 of the trailing vane 16 occurs. In order to alleviate this problem, the bolted connection is eliminated and the radially outer band 12 is formed with a hook 22 and a radial load carrying land 24 adjacent one circumferential end. A radially load carrying, circumferentially, extending member 26 is formed on an opposite circumferential end of the band 12 for mating with land 24 when the nozzle segments 10 are in an assembled configuration. The support 18, which may comprise a plurality of circumferential segments, incorporates a plurality of studs 28 each aligned with a respective one of the hooks 22.

Figure 3:
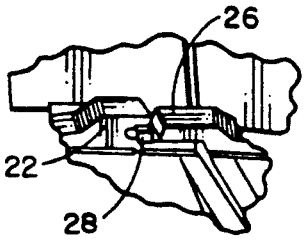
FIG. 3 is an enlarged view of area A of FIG. 2.

Referring to FIG. 3, which is an enlarged view of the area A of FIG. 2, it can be seen that the hook 22 captures the stud 28 between itself and the land 24. The land 24 extends circumferentially beyond the hook 22 leaving space for receiving the extending support member 26 from an adjacent segment 10. The stud 28 carries the tangential and radial load from the nozzle segment 10. The support member 26 loads radially downward on the land 24 of an adjacent nozzle to prevent rotating about the stud 28 in a plane normal to the axis of the engine. Referring again to FIG. 1, the rotation of the segment 10 axially about stud 28 is prevented by an axially formed flange 30 which engages a forward stationary support member 32 coupled to the engine frame.

While the invention is illustrated in what is presently considered to be a best mode, various modifications will become apparent to those skilled in the art, including modifications to adapt the invention to other engine designs. For example, although the hook 22 is shown extending radially above the band 12 with a circumferential opening, some applications may require lowering of the hook into the plane of the band or forming the band with a slot to receive the stud 28 rather than using the hook 22. Further, it may be desirable to use a tongue and groove arrangement to replace the land 24 and support member 26. Accordingly, it is intended that the invention be interpreted within the full spirit and scope of the appended claims.

What is claimed is:

1. A turbine nozzle for coupling to a nozzle support member, the support member having a plurality of axially extending studs, the nozzle comprising:

plurality of nozzle segments arranged in a circumferentially abutting relationship for forming a generally continuous nozzle;

a first band attached to each of said nozzle segments, said first band including a hook positioned adjacent a first circumferential end thereof for engaging a respective one of the studs for supporting said segments against tangential and radial loads;

a land extending circumferentially at said first end of said band; and a support member extending from a second circumferential end of said band, said support member on each band of said segments overlaying a respective land on a band of an adjacent one of said segments and being supported thereby against radial rotation of said nozzle segment.

2. The turbine nozzle of claim 1 and including a flange positioned adjacent an axially forward edge of said band and extending circumferentially of each of said nozzle segments, and further including a second support member coupled to the engine for engaging said second flange for inhibiting axial rotation of said nozzle segment.

3. The turbine nozzle of claim 1 wherein said hook extends above said flange and opens in a circumferential direction.

4. The turbine nozzle of claim 2 wherein said first band is coupled to a radially outer end of said nozzle segment, and further including a radially inner band coupled to said nozzle segment and arranged to define a radially inner gas flowpath boundary when said segments are in an assembled configuration.

5. The turbine nozzle of claim 4 wherein said first band of each of said segments extends circumferentially and axially for forming a continuous closed surface defining an outer gas flowpath boundary when said segments are in an assembled configuration.

* * * * *